US009332787B2

(12) United States Patent
Liu

(10) Patent No.: US 9,332,787 B2
(45) **Date of Patent: *May 10, 2016**

(54) ELECTRONIC CIGARETTE WITH MAGNETIC CONNECTION

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 480 days.

This patent is subject to a terminal disclaimer.

(21) Appl. No.: 13/820,505

(22) PCT Filed: Sep. 27, 2012

(86) PCT No.: PCT/CN2012/082136

§ 371 (c)(1),
(2) Date: Mar. 1, 2013

(87) PCT Pub. No.: WO2014/047826

PCT Pub. Date: Apr. 3, 2014

(65) Prior Publication Data

US 2014/0190502 A1 Jul. 10, 2014

(51) Int. Cl.
*A24F 47/00* (2006.01)

(52) U.S. Cl.
CPC ..... *A24F 47/008* (2013.01)

(58) Field of Classification Search
CPC ..... A24F 47/008; A61M 15/0001
See application file for complete search history.

(56) References Cited

U.S. PATENT DOCUMENTS

| | | | | |
|---|---|---|---|---|
| 2011/0011396 | A1* | 1/2011 | Fang | 128/202.21 |
| 2013/0042865 | A1* | 2/2013 | Monsees et al. | 128/203.27 |
| 2013/0152922 | A1* | 6/2013 | Benassayag et al. | 128/202.21 |
| 2013/0169230 | A1* | 7/2013 | Li et al. | 320/114 |
| 2013/0220315 | A1* | 8/2013 | Conley et al. | 128/202.21 |
| 2013/0255702 | A1* | 10/2013 | Griffith et al. | 131/328 |
| 2013/0327327 | A1* | 12/2013 | Edwards et al. | 128/203.11 |
| 2014/0014124 | A1* | 1/2014 | Glasberg et al. | 131/328 |
| 2014/0020696 | A1* | 1/2014 | Liu | 131/329 |
| 2014/0053857 | A1* | 2/2014 | Liu | 131/329 |
| 2014/0053858 | A1* | 2/2014 | Liu | 131/329 |
| 2014/0131388 | A1* | 5/2014 | Heisel et al. | 222/192 |
| 2014/0150783 | A1* | 6/2014 | Liu | 128/202.21 |
| 2014/0150784 | A1* | 6/2014 | Liu | 128/202.21 |
| 2014/0182609 | A1* | 7/2014 | Liu | 131/329 |
| 2014/0290677 | A1* | 10/2014 | Liu | 131/329 |
| 2014/0299140 | A1* | 10/2014 | Liu | 131/329 |

(Continued)

*Primary Examiner* — Jason L Lazorcik
(74) *Attorney, Agent, or Firm* — Cheng-Ju Chiang

(57) ABSTRACT

The present invention relates an electronic cigarette with magnetic connection, comprising an inhaling shell and a power shell, a connection end of the inhaling shell coupled to the power shell is set with a first connector, the first connector comprises a first seat and a first terminal post, the first seat wholly or partly forms a first magnetic-attraction part; a connection end of the power shell is set with a second connector, the second connector comprises a second seat and a second terminal post, the second seat wholly or partly forms a second magnetic-attraction part which can magnetically attracts the first magnetic-attraction part; the first magnetic-attraction part and the second magnetic-attraction part attracts each other; which makes the electronic cigarette assembling and disassembling conveniently and quickly, the electronic cigarette appearance attract, forming a special air passage, air in and out of the electronic cigarette circulates smoothly.

11 Claims, 6 Drawing Sheets

(56) References Cited

U.S. PATENT DOCUMENTS

2014/0332019 A1* 11/2014 Liu ..... 131/329
2014/0352707 A1* 12/2014 Liu ..... 131/329
2014/0360516 A1* 12/2014 Liu ..... 131/329
2014/0366896 A1* 12/2014 Li et al. ..... 131/329
2015/0020827 A1* 1/2015 Liu ..... 131/329

* cited by examiner

ELECTRONIC CIGARETTE WITH MAGNETIC CONNECTION

CROSS REFERENCE TO RELATED APPLICATIONS

The present application is a 35 U.S.C. §371 National Phase conversion of International (PCT) Patent Application No. PCT/CN2012/082136, filed on Sep. 27, 2012, the disclosure of which is incorporated by reference herein. The PCT International Patent Application was filed in Chinese.

FIELD OF THE INVENTION

The present invention relates to electronic cigarette, and especially to an electronic cigarette with magnetic connection.

BACKGROUND OF THE INVENTION

Existing electronic cigarette comprises an inhaling shell and a power shell, the inhaling shell and the power shell is connected by magnetic attraction. The inhaling shell is set with a first magnetic-attraction part on its position where is coupled to the power shell, and the power shell is correspondingly set with a second magnetic-attraction part to magnetically connect with the first magnetic-attraction part so that the inhaling shell and the power shell are steadily coupled; since a connection end of the inhaling shell and a connection end of the power shell have many components therein, it takes time and is inconvenient to assemble the inhaling shell and the power shell.

BRIEF SUMMARY OF THE INVENTION

An object of the present invention is to provide an electronic cigarette with magnetic connection which makes assembly of the electronic cigarette convenient and quick.

To achieve the above object, the present invention provides an electronic cigarette with magnetic connection comprising an inhaling shell and a power shell, wherein, a connection end of the inhaling shell coupled to the power shell is set with a first connector, the first connector comprises a first seat and a first terminal post respectively used as a first and a second electrodes of the first connector, the first seat wholly or partly forms a first magnetic-attraction part; a connection end of the power shell coupled to the inhaling shell is set with a second connector, the second connector comprises a second seat and a second terminal post respectively used as a first and a second electrodes of the second connector, the second seat wholly or partly forms a second magnetic-attraction part which can magnetically attracts the first magnetic-attraction part; the first magnetic-attraction part and the second magnetic-attraction part attracts each other, which makes the first seat and the second seat contacted and makes the first terminal post and the second terminal post contacted.

Furthermore, the first connector comprises a first insulation sleeve for spacing the first seat and the first terminal post, the first seat is shaped as a cylinder, the first terminal post is inserted in center of the first seat via the first insulation sleeve; the second connector further comprises a second insulation sleeve for spacing the second seat and the second terminal post, the second seat is shaped as a cylinder, and the second terminal post is inserted in center of the second seat via the second insulation sleeve.

Furthermore, the second terminal post is inserted in the second insulation sleeve, the second insulation sleeve is mounted in an insulation base and is inserted in center of the second seat via the insulation base, an end of the second terminal post within the insulation base is set with a stop flange, and the end of the second terminal post within the insulation base is inserted in a spring, both ends of the spring respectively abut against the stop flange and an inner end wall of the insulation base so as to keep the second terminal post extending; a lower section of the second terminal post extends out of a bottom wall of the second seat, the second terminal post defines an air hole axially through its center.

Furthermore, the insulation seat is shaped as a cup, comprises a sidewall, a bottom wall and a protruding bar longitudinally extending outsides from the bottom wall; the sidewall and the bottom wall enclose a first inner cavity for accommodating the second terminal post, and the bottom wall further defines a first terminal hole for passing the second terminal post.

Furthermore, the second insulation sleeve is shaped as a cup, comprises a sidewall and a bottom wall, the sidewall and the bottom wall of the second insulation sleeve enclose a second inner cavity for accommodating the second terminal post.

Furthermore, the second insulation sleeve further comprises a flange radially extending outwards from the sidewall of the second insulation sleeve, and a guiding part axially extending from the bottom wall of the second insulation sleeve, the guiding part further defines a second terminal hole axially through center of the guiding part and communicating with the second inner cavity; the second insulation sleeve is mounted with interference fit in an inner wall of the first inner cavity of the insulation base via the sidewall of the second insulation sleeve, and is axially fixed via the flange abutting against an open end of the first inner cavity of the insulation base.

Furthermore, the first magnetic absorption part is wholly made from conductive magnetic iron or magnetic materials, or the first magnetic absorption part is partly made from conductive materials; the second magnetic absorption part is wholly made from conductive magnetic iron or magnetic materials, or the second magnetic absorption part is partly made from conductive materials.

Furthermore, the second seat defines an air passage therein for receiving the first seat, the second magnetic absorption part is a permanent magnet, the permanent magnet is fixed in the air passage of the second seat, and one end of the first seat is inserted in the second seat and keeps a preset distance from the permanent magnet.

Furthermore, the air passage of the second seat is an axially-thorough hole, an inner wall of the air passage forms a positioning step, the second terminal post is inserted in the second seat and abuts against one end of the permanent magnet so that the other end of the permanent magnet abuts against the positioning step, therefore the permanent magnet is fixed in the air passage of the second seat.

Furthermore, the second seat has a shape adapted to an inner wall of the connection end of the power shell, has a cylindrical structure, and is fixed with interference fit in the inner wall of the connection end of the power shell via its outer wall; a fixed flange adapted to the connection end of the power shell radially extends outwards from an end wall of the second seat, and the fixed flange radially defines a thorough air inlet.

Furthermore, the first seat comprises a cylindrical upper section and a cylindrical lower section, the upper section is used for coupling the connection end of the inhaling shell, the lower section is used for coupling the second seat; a positioning flange is formed between the upper section and the lower section and axially extends outwards for engaging with the connection end of the inhaling shell, the positioning flange is used to abut against and limit the second seat; the lower section forms a snap ring on its inner wall for mounting the first terminal post, the first terminal post is fixed in the snap ring via the first insulation sleeve, and the first terminal post defines an air hole axially through its center.

Furthermore, the lower section of the first seat defines an annular air groove near the positioning flange, and an air inlet is defined radially through the annular air groove.

Furthermore, the inhaling shell is set with a tobacco-liquid cup and an atomizer therein, the power shell is set with a storage battery therein; the first electrode and the second electrode of the first connector respectively connect with positive and negative electrodes of the atomizer; and the first electrode and the second electrode of the second connector respectively connect with the positive and negative electrodes of the storage battery.

Using the above technical proposals, the electronic cigarette with magnetic connection has advantages as follows: first, the first connector of the inhaling shell is set with a first terminal assembly which is assembled as a whole, the second connector of the power shell is set with a second terminal assembly which is assembled as a whole, the first connector and the second connector as a whole bring relatively few components and parts, which imparts assembly and disassembly of the electronic cigarette convenient and quick. Secondly, the lower section of the first seat is inserted in the air passage of the second seat and keep a proper space from the permanent magnet, the space between the first seat and the permanent magnet ensures the first connector and the second connector attracting and closely contacting each other, thus ensures electric circuit switched on and that the inhaling shell and the power shell are attracted and connected with each other; the inhaling shell and the power shell are connected without any gap, which brings the electronic cigarette an attract appearance; the space between the first seat and the permanent magnet facilitates inner air flowing. Furthermore, the electronic cigarette forms a special air passage therein, air in and out of the electronic cigarette circulates smoothly.

The following detailed description of a preferred embodiment thereof when taken in conjunction with the accompanying drawings.

DETAILED DESCRIPTION OF THE INVENTION

It is necessary to declare that, under no conflict situation, the embodiments or characteristics of the embodiments of the present invention can be combined each other, the present invention is described in detail in cooperation with drawings and embodiments as follows.

Figure 1:
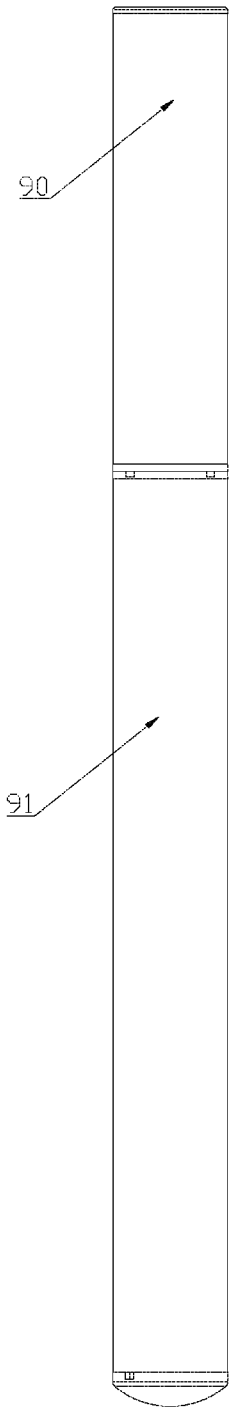
FIG. 1 is a front elevational view of an electronic cigarette in accordance with an embodiment of the present invention.

As shown in FIGS. 1 to 8, an embodiment of the present invention provides an electronic cigarette with magnetic connection, the electronic cigarette with magnetic connection comprises an inhaling shell 90 and a power shell 91, an connection end of the inhaling shell 90 coupled to the power shell 91 is set with a first connector 5, an connection end of the power shell 91 coupled to the inhaling shell 90 is set with a second connector 6, the inhaling shell 90 and the power shell 91 is connected with each other as a whole via magnetic attraction, and the embodiment is takes a direction as shown in FIG. 1.

Figure 2:
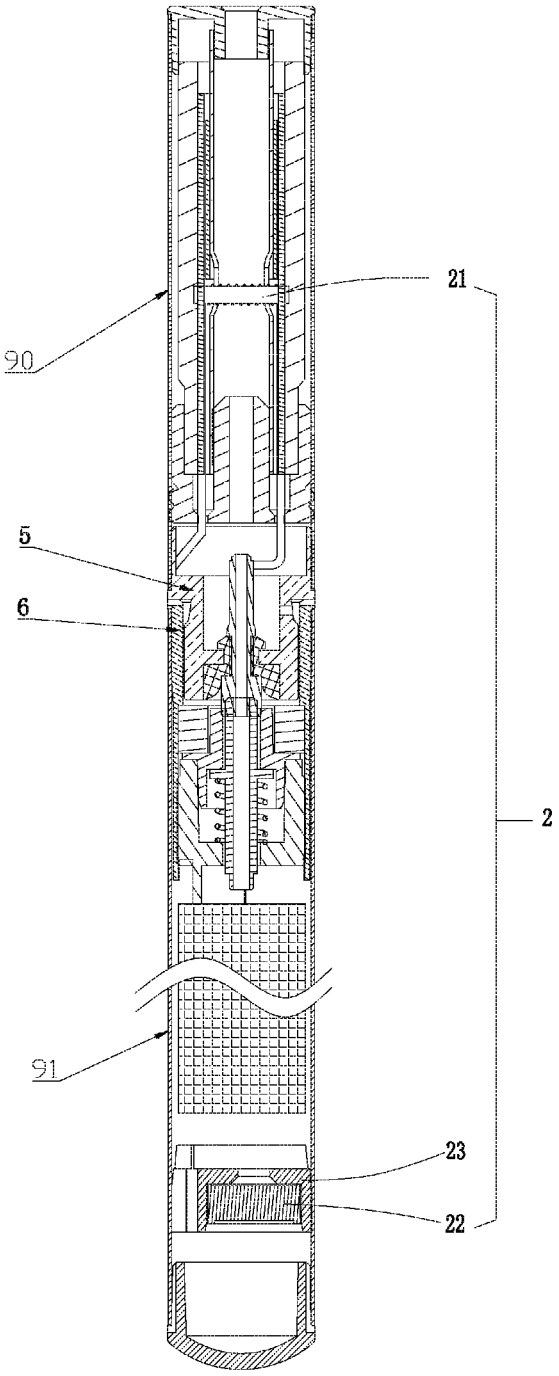
FIG. 2 is a cross-sectional view of the electronic cigarette in accordance with the embodiment of the present invention.
Figure 3:
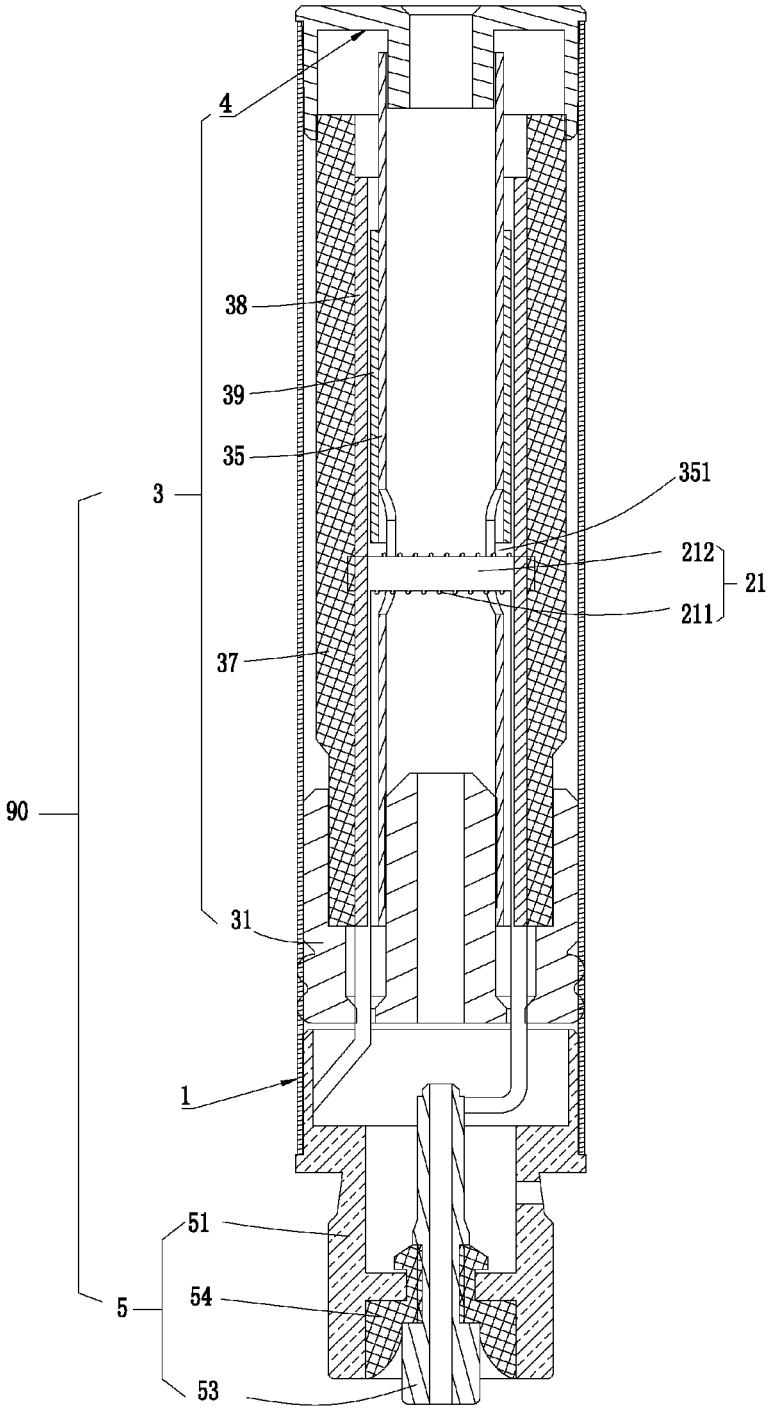
FIG. 3 is a cross-sectional view of an inhaling shell of the electronic cigarette in accordance with the embodiment of the present invention.

As shown in FIGS. 2 to 3, the inhaling shell 90 comprises a hollow cylindrical inhaling tube 1, an atomizing device 2, a tobacco-liquid cup 3, a mouth cover 4 and the first connector 5 for being connected with the power shell 91. The mouth cover 4 and the first connector 5 are respectively mounted at both ends of the inhaling tube 1, and the atomizing device 2 and the tobacco-liquid cup 3 are located in the inhaling tube 1.

The first connector 5 comprises a first seat 51, a first terminal post 53, and a first insulation sleeve 54, and the first terminal post 53 defines a vent hole in a central part. The first terminal post 53 is fitted in the first insulation sleeve 54, the first terminal post 53 is inserted in a center of the first seat 51 by means of the first insulation sleeve 54; and the first terminal post 53 and the first insulation sleeve 54 constitute a first terminal assembly. In this embodiment, the first seat 51 and the first terminal post 53 are respectively used as a first electrode (such as negative electrode) and a second electrode (such as a positive electrode) of the first connector 5.

Figure 7:
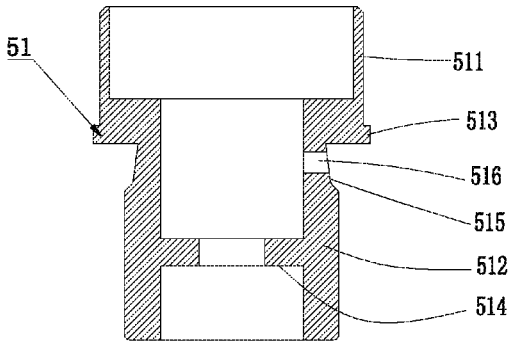
FIG. 7 is a cross-sectional view of a first seat of the electronic cigarette in accordance with the embodiment of the present invention.

As shown in FIGS. 3 and 7, the first seat 51 is located at a second end of the inhaling tube 1, has a shape suited to the inhaling tube 1, is made from materials of magnetic properties able to be attracted by a magnet such as a iron material, and is inserted into the inhaling tube 1 and abuts against a cup seat 31. The first seat 51 is shaped about a hollow cylinder, comprises a cylindrical upper section 511 and a cylindrical lower section 512, the upper section 511 is used for coupling the inhaling tube 1, the lower section 512 is used for coupling the power shell 91; a positioning flange 513 is formed between the upper section 511 and the lower section 512, meanwhile, the positioning flange 513 is used to abut against and limit the power shell 91; the lower section 512 forms a snap ring 514 on its inner wall for mounting the first terminal assembly. The lower shell 512 defines an annular air groove 515 near the positioning flange 513, and an air inlet 516 is defined radially through the annular air groove 515.

The atomizing device 2 comprises an atomizer 21, an atomizer control circuit board 22, and a circuit board seat 23 for receiving and fixing the atomizer control circuit board 22; in this embodiment, the atomizer 21 is disposed in the inhaling tube 1; the atomizer control circuit board 22 and circuit board seat 23 are arranged in the power shell 91; and the atomizer control circuit board 22 is set with a Mini Air Operated Switch for controlling circuit switched on to start the atomizer 21.

As shown in FIG. 3, the atomizer 21 is used for vaporizing tobacco liquid into smoke, comprises electric heat wire 211 and a fiber member 212 for absorbing tobacco liquid and supporting the electric heat wire 211; the electric heat wire 211 winds around the fiber member 212; the fiber member 212 can absorb and store liquid like a sponge, which can be made from glass fiber or materials with property of liquid absorption and separation such as cotton materials. In this embodiment, the fiber member 212 is holden in the tobacco-liquid cup 3, and the electric heat wire 211 has both ends thereof passing through the tobacco-liquid cup 3 and then connected with the negative electrode and positive electrode of the power shell 91.

As shown in FIG. 3, in this embodiment, the tobacco-liquid cup 3 comprises the cup seat 31, the mouth cover 4, a duct 35, a liquid-storage piece 37, a seepage piece 38, and a positioning tube 39 for preventing the atomizer 21 axially moving. Herein, the cup seat 31 and the mouth cover 4 are both oppositely spaced and mounted in inner wall of the inhaling tube 1; the duct 35 is mounted between the cup seat 31 and the mouth cover 4; the liquid-storage piece 37 is fixed outside of the duct 35 and is located between the cup seat 31 and mouth cover 4. For increasing the using life and heat resistance of the liquid-storage piece 37, the liquid-storage piece 37 therein is fitted with the seepage piece 38; the seepage piece 38 can also absorb or store liquid like a sponge and is made from heat-resistant materials with property of liquid absorption and separation; and the seepage piece 38 is fitted between outer sidewall of the duct 35 and inner sidewall of the liquid-storage piece 37. The positioning tube 39 is fitted on outer wall of the duct 35 and abuts against the atomizer 21.

As shown in FIG. 3, in this embodiment, the cup seat 31 is shaped like a cylinder; comprises an annular sidewall, a round cup bottom, and a location column axially extending from a central section of the cup bottom. Wherein, an annular inner cavity is defined between the annular sidewall and the location column; a blowhole is defined axially through the location column and the cup bottom; through wire holes (not shown) for electric heat wire 211 are defined in the cup bottom. Tension loops are formed on the sidewall for interference fit with the inhaling tube 1, and the cup seat 31 is fixed with interference fit in the inner wall of the inhaling tube 1 via its sidewall and the tension loops.

The mouth cover 4 may be made from silicone materials, has a shape and size adapted to the inner wall of the inhaling tube 1. In this embodiment, the mouth cover 4 is shaped as a cylindrical cap; comprises outer annular sidewall, top wall, a location post axially extending from a central section of the top wall; and an annular cavity is defined between the location post and the sidewall. The mouth cover 4 further comprises a vent hole axially through the location post and the top wall, a positioning step radially extending outwards and adapted to the first end of the inhaling tube 1. The mouth cover 4 has an outer diameter slightly greater than an inner diameter of the inhaling tube 1, and is fixed with interference fit in the inner wall of the inhaling tube 1 via its sidewall. When tobacco liquid in the tobacco-liquid cup 3 is exhausted, tobacco liquid can be refilled into the tobacco-liquid cup 3 after removing the mouth cover 4. The location post of the mouth cover 4 and the location column of the cup seat 31 are arranged opposite to each other, for respectively fixing either end of the duct 35. The annular cavity of the mouth cover 4 and the annular cavity of the cup seat 31 are arranged opposite to each other, for respectively holding either end of the liquid-storage piece 37.

The duct 35 (referring to FIG. 3) is used to support the liquid-storage piece 37 and the seepage piece 38, at the same time is used to control the height of the tobacco-liquid cup 3 and support the fiber member 212, and further used to pass mist out to the inhaling tube 1 after tobacco liquid is vaporized by the atomizer 2. In this embodiment, the duct 35 is a hollow circular tube, maybe made from plastic or fiber materials, such as being a glass-fiber tube, comprises a top section and a lower section, its top section is fitted and sealed around the location post of the mouth cover 4, and its lower section is fitted and sealed around the location column of the cup seat 31. The duct 35 defines slots 351 through its wall, for supporting and fixing the fiber member 212; and the fiber member 212 crosses the duct 35 therein with both ends thereof respectively passing through the snots 351 and contacting the liquid-storage piece 37 for absorbing tobacco liquid for vaporization by the electric heat wire 211.

The liquid-storage piece 37 is used for absorbing and storing tobacco liquid filled in the tobacco-liquid cup 3 for vaporization by the atomizer 2, can absorb and store liquid like a sponge, and maybe made from materials with a property of absorbing liquid and isolating liquid such as cotton material. The liquid-storage piece 37 has a hollow cylindrical structure, is fitted on outside of the duct 35 and is supported with interference fit on outside of the duct 35, and has both ends thereof respectively inserted into the annular cavity of the cup seat 31 and the annular cavity of the mouth cover 4. Sidewall of the liquid-storage piece 37 abuts against the fiber piece 212, and tobacco liquid penetrates into and is absorbed by the fiber piece 212 from the liquid-storage piece 37 for being vaporized into mist by the electric heat wire 211.

The positioning tube 39 is used for limiting a position of the atomizer 21 on the duct 35, the positioning tube 39 is an insulate hollow circular tube adapted to the duct 35, maybe made from plastic or fiber, such as glass-fiber tube; the positioning tube 39 is fitted on outer wall of the duct 35, the positioning tube 39 is engaged with the duct 35 by interference fit, and an end of the positioning tube 39 abuts against the atomizer 21 for preventing the atomizer 21 from axially moving along the duct 35

Figure 4:
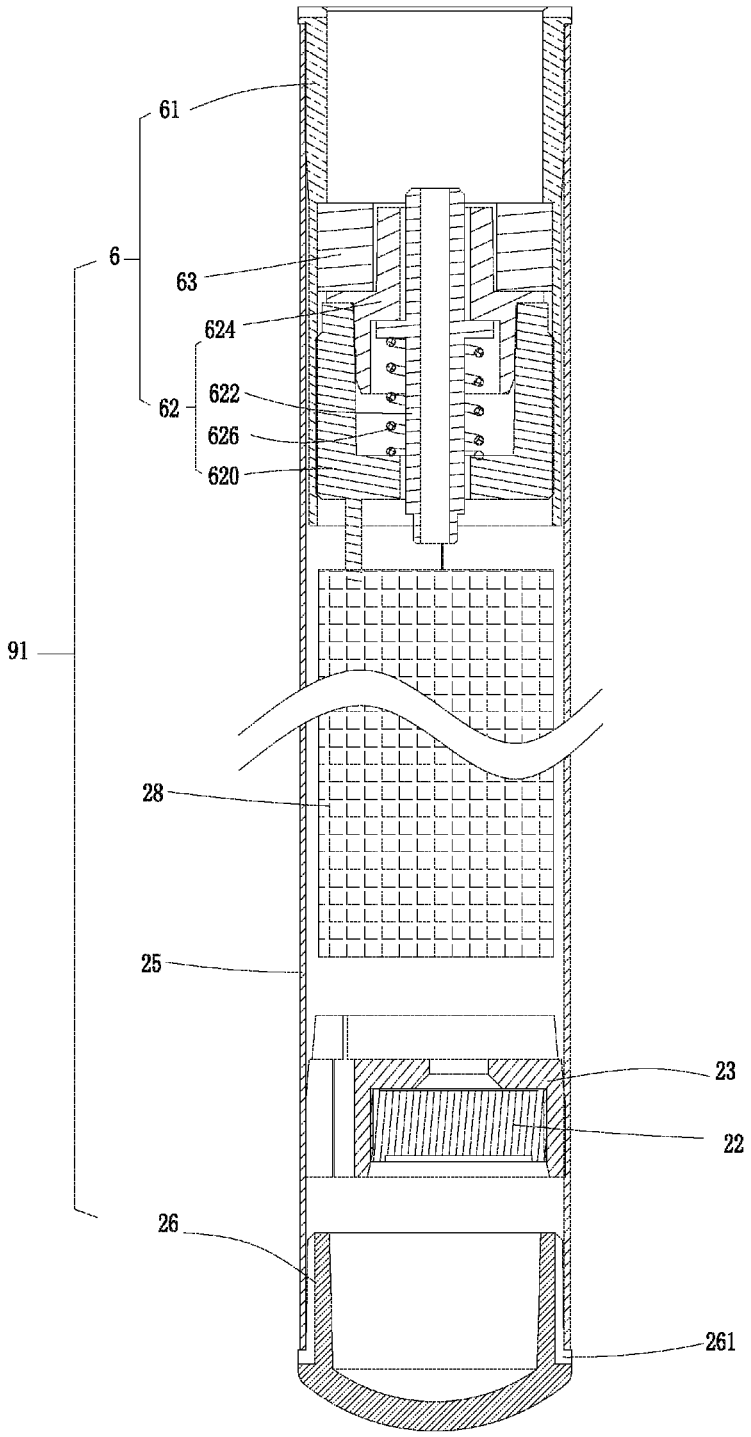
FIG. 4 is a cross-sectional view of a power shell of the electronic cigarette in accordance with the embodiment of the present invention.

As shown in FIGS. 2 and 4, the power shell 91 is wholly shaped as a cylinder, comprises a casing 25, an end of the casing 25 coupled to the inhaling shell 90 is set with a second connector 6 to connect with the first connector 5, the casing 25 is set with such parts as storage battery 28 therein. Another end of the power shell 91 is set with an end cover 26, and the end cover defines air inlet port 261.

Figure 8:
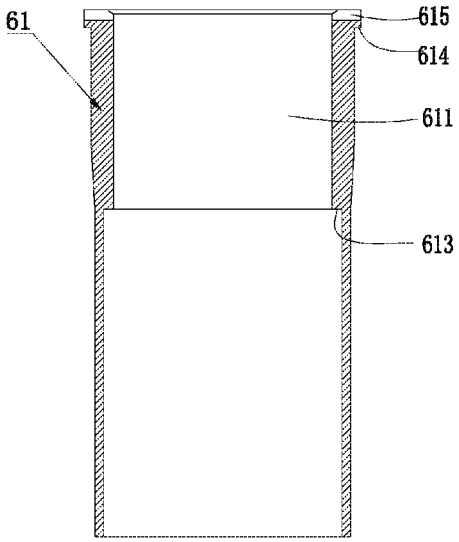
FIG. 8 is a cross-sectional view of a second seat of the electronic cigarette in accordance with the embodiment of the present invention.

As shown in FIGS. 4 and 8, the second connector 6 comprises a second seat 61, and a second terminal assembly 62 and a permanent magnet 63 in the second seat 61. The second terminal assembly 62 is inserted in the second seat 61 and abuts against the permanent magnet 63 for fixing the permanent magnet 63 in the second seat 61.

As shown in FIG. 8, the second seat 61 is shaped about a hollow cylinder, its inner defines an air passage 611 axially therethrough; an inner wall of the air passage 611 forms a positioning step 613 to divide the air passage 611 as an upper passage with a relatively smaller diameter and an lower passage with a relatively bigger diameter; the positioning step 613 is used to fix the permanent magnet 63, the second terminal assembly 62 is inserted in the lower passage and abuts against one end of the permanent magnet 63, the permanent magnet 63 has the other end abutting against the positioning step 613 so that the permanent magnet 63 is fixed in the lower passage; the upper passage is adapted to the lower section 512 of the first seat 51 for the first seat 51 being inserted. A fixed flange 614 radially extends outwards from an end sidewall of the second connector 6, and the fixed flange 614 radially defines a thorough air inlet 615.

Figure 5:
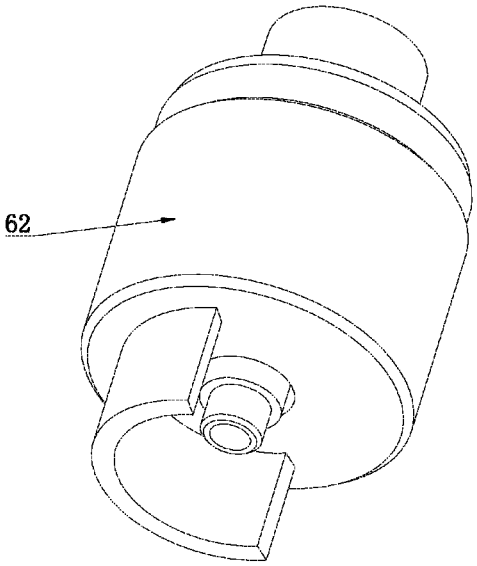
FIG. 5 is a perspective view of a second terminal post of the electronic cigarette in accordance with the embodiment of the present invention.
Figure 6:
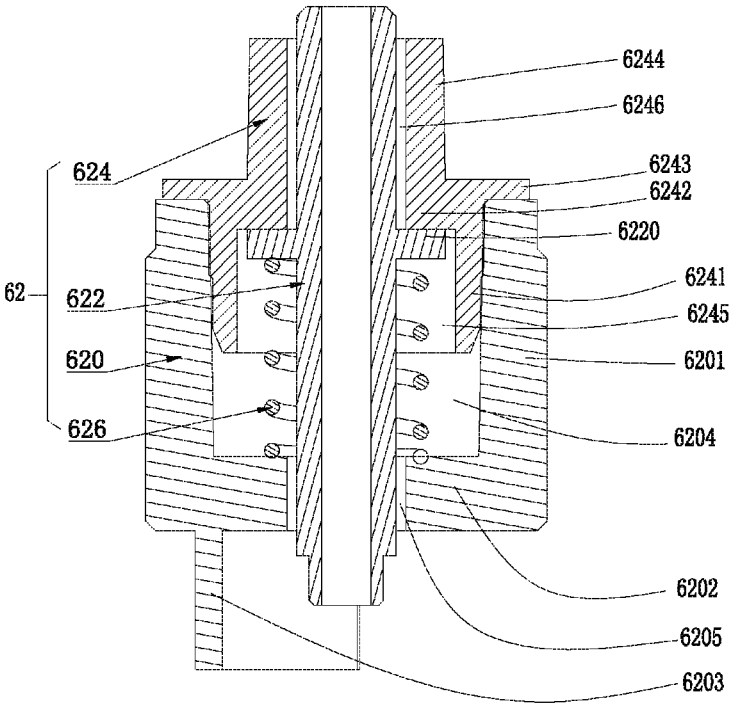
FIG. 6 is a cross-sectional view of the second terminal post of the electronic cigarette in accordance with the embodiment of the present invention.

As shown in FIGS. 4 to 6, the second terminal assembly 62 comprises an insulation base 620, a second terminal post 622 disposed in center of the base 620, a spring 626 fitted around the second terminal post 622 and a second insulation sleeve 624 disposed between the insulation base 620 and the second terminal post 622. The insulation base 620, the second terminal post 622, the second insulation sleeve 624 and the spring 626 constitute the second terminal assembly 62, are assembled as a whole, which facilitates assembly and disassembly of the electronic cigarette conveniently, and make the assembly and disassembly of the electronic cigarette simply and quickly.

The insulation base 620 is shaped about a cup, is made from insulate materials, comprises a sidewall 6201, a bottom wall 6202 and a protruding bar 6203 longitudinally extending outsides from the bottom wall 6202 so as to facilitate soldering; the sidewall 6201 and the bottom wall 6202 enclose an inner cavity 6204 for accommodating the second terminal post 622, the bottom wall 6202 further defines a first terminal hole 6205 for passing the second terminal post 622. The second terminal post 622 is inserted in the second insulation sleeve 624, one end thereof extending outwards for coupling a corresponding terminal post of external connector, another end of the second terminal post 622 within the insulation base 620 is set with a stop flange 6220, and the spring 626 is fitted around the end of the second terminal post 622 within the insulation base 620, both ends of the spring 626 respectively abuts against the stop flange 6220 and the bottom wall 6202 of the insulation base 620, and the spring 626 keeps the second terminal post 622 extending outwards. The second insulation sleeve 624 is also shaped about a cup, comprises a sidewall 6241, bottom wall 6242, and a flange 6243 radially extending outwards from the sidewall 6241, and a guiding part 6244 axially extending from the bottom wall 6242, the sidewall 6241 and the bottom wall 6242 enclose an inner cavity 6245 for accommodating the second terminal post 622, the guiding part 6244 further defines a second terminal hole 6246 axially through center of the guiding part 6244 and communicating with the inner cavity 6245. The second insulation sleeve 624 is mounted with interference fit in the inner wall of the inner cavity 6204 of the insulation base 620 via the sidewall 6241 and is axially fixed via the flange 6243 abutting against an open end of the inner cavity 6204 of the insulation base 620. One end of the second terminal post 622 passes the second terminal hole 6246 and extends outside of the guiding part 6244, the stop flange 6220 of the second terminal post 622 keeps abutting against the bottom wall 6242 of the second insulation sleeve 624 because of the force of the spring 626, and another end of the second terminal post 622 passes the first terminal hole 6205 and extends outside of the bottom wall 6202 of the insulation base 620.

As shown in FIG. 4, the permanent magnet 63 has an annular structure, the permanent magnet 63 is hollow in center (not labeled) for passing the second terminal post 622 therethrough, and the permanent 63 is fixed in the second connector 6.

The first seat 51 wholly or partly forms a first magnetic absorption part, and in this embodiment, the first seat 51 wholly forms the first magnetic absorption part. The second seat 61 wholly or partly forms a second magnetic absorption part which may magnetically attract the first magnetic absorption part. For better position and fixing when the second seat 61 of the power shell 91 couple to the first seat 51 of the inhaling shell 90, the first seat 51 may be made from conductive magnetic materials or magnetic iron, the magnetic materials may be iron materials; therefore, the first seat 51 forms the first magnetic absorption part, otherwise, the first seat 51 can be set with an independent component made from conductive magnetic materials or magnetic iron as the first magnetic absorption part; or a part of the first magnetic absorption part is made from conductive materials. Accordingly, the second seat 61 may be made from conductive magnetic materials or magnetic iron, thus the second seat 61 wholly forms the second magnetic absorption part which attracts the first magnetic absorption part of the first seat 51; or the second seat 61 can be set with an independent component made from conductive magnetic materials or magnetic iron as the second magnetic absorption part; or a part of the second magnetic absorption part is made from conductive materials. In this embodiment, the permanent magnet 63 is used as the second magnetic absorption part which is independently configured and is made from magnet or magnetic materials. Therefore, a relation between the first magnetic absorption part and the second magnetic absorption part may be such relation between a magnetic iron and a magnetic iron, between a magnetic iron and a magnetic material, or between a magnetic material and a magnetic iron.

As shown in FIG. 2, until the first connector 5 of the inhaling shell 90 is inserted in place into the second connector 6 of the power shell 91, herein, the lower section 512 of the first seat 51 is inserted in the air passage 611 of the second seat 61, while the second terminal post 622 of the second connector 6 is pushed by an end of the first terminal post 53 of the first connector 5 to overcome the resilience force of the spring 626 and slightly retract, and thus tightly abuts against the first terminal post 53 under the force of the spring 626, which ensures a good contact between the first terminal post 53 and the second terminal post 622; furthermore, the lower section 512 of the first seat 51 is spaced to and not abut against the permanent magnet 63, which ensures the first connector 5 and the second connector 6 to closely attract each other, ensures electric circuit switched and that the inhaling shell 90 and the power shell 91 are attracted and connected with each other without any gap, and then ensures a good contact between the first connector 5 and the second connector 6, thus the electric circuits of the inhaling shell 90 and the power shell 91 are intercommunicated, as for the appearance, no gap existing between the inhaling shell 90 and the power shell 91 makes the electronic cigarette more aesthetic.

As shown in FIGS. 2 to 4, air in external environment enters into the power shell 91 from the air inlet port 261 in the end cover 26 at the bottom of the power shell, passes through hollow center of the second terminal post 622 and the hollow center of the first terminal post 53 and enters into the inhaling shell 90; or, air in external environment enters into the inhaling shell 90 from the air inlet 615 in the second connector 6 of the power shell 91 and through the annular air groove 515 in the first connector 5 of the inhaling shell 90, then successively passes through the blowhole in the cup seat 31 of the tobacco-liquid cup 3, through the hollow duct 35 and through the vent hole in the mouth cover 4 and then flows out of the inhaling shell 90, which forms a special air passage in the electronic cigarette, air in and out of the electronic cigarette circulates smoothly. Of course, air in external environment can also arrive in the duct 35 through the inhaling shell 90 from the vent hole in the mouth cover 4.

Some appropriate improvements and modifications can be done according to the above embodiments of the present invention, for example, the positions of the first connector 5 and the second connector 6 can be interchanged; other components are correspondingly adjusted.

The above mentioned is only exemplary embodiments of the present invention. It should be noted, for persons of ordinary skill in this art field, improvements and modifications within the spirit of the present invention can be further made, and such improvements and modifications should be seemed to be included in the claimed scope of the present invention.

What is claimed is:

1. An electronic cigarette with magnetic connection, comprising an inhaling shell and a power shell, wherein, a connection end of the inhaling shell coupled to the power shell is set with a first connector, the first connector comprises a first seat and a first terminal post respectively used as a first and a second electrodes of the first connector, the first seat wholly or partly forms a first magnetic-attraction part; a connection end of the power shell coupled to the inhaling shell is set with a second connector, the second connector comprises a second seat and a second terminal post respectively used as a first and a second electrodes of the second connector, the second seat wholly or partly forms a second magnetic-attraction part which can magnetically attracts the first magnetic-attraction part; the first magnetic-attraction part and the second magnetic-attraction part attracts each other, which makes the first seat and the second seat contacted and makes the first terminal post and the second terminal post contacted;

the first connector further comprises a first insulation sleeve for spacing the first seat and the first terminal post, the first seat is shaped as a cylinder, the first terminal post is inserted in center of the first seat via the first insulation sleeve; the second connector further comprises a second insulation sleeve for spacing the second seat and the second terminal post, the second seat is shaped as a cylinder, and the second terminal post is inserted in center of the second seat via the second insulation sleeve;

the second terminal post is inserted in the second insulation sleeve, the second insulation sleeve is mounted in an insulation base and is inserted in center of the second seat via the insulation base, an end of the second terminal post within the insulation base is set with a stop flange, and the end of the second terminal post within the insulation base is inserted in a spring, both ends of the spring respectively abut against the stop flange and an inner end wall of the insulation base so as to keep the second terminal post extending; a lower section of the second terminal post extends out of a bottom wall of the second seat, the second terminal post defines an air hole axially through its center.

2. The electronic cigarette with magnetic connection of claim 1, wherein, the insulation seat is shaped as a cup, comprises a sidewall, a bottom wall and a protruding bar longitudinally extending outsides from the bottom wall; the sidewall and the bottom wall enclose a first inner cavity for accommodating the second terminal post, and the bottom wall further defines a first terminal hole for passing the second terminal post.

3. The electronic cigarette with magnetic connection of claim 2, wherein, the second insulation sleeve is shaped as a cup, comprises a sidewall and a bottom wall, the sidewall and the bottom wall of the second insulation sleeve enclose a second inner cavity for accommodating the second terminal post.

4. The electronic cigarette with magnetic connection of claim 3, wherein, the second insulation sleeve further comprises a flange radially extending outwards from the sidewall of the second insulation sleeve, and a guiding part axially extending from the bottom wall of the second insulation sleeve, the guiding part further defines a second terminal hole axially through center of the guiding part and communicating with the second inner cavity; the second insulation sleeve is mounted with interference fit in an inner wall of the first inner cavity of the insulation base via the sidewall of the second insulation sleeve, and is axially fixed via the flange abutting against an open end of the first inner cavity of the insulation base.

5. The electronic cigarette with magnetic connection of claim 1, wherein, the first magnetic absorption part is wholly made from conductive magnetic iron or magnetic materials, or the first magnetic absorption part is partly made from conductive materials; the second magnetic absorption part is wholly made from conductive magnetic iron or magnetic materials, or the second magnetic absorption part is partly made from conductive materials.

6. The electronic cigarette with magnetic connection of claim 1, wherein, the inhaling shell is set with a tobacco-liquid cup and an atomizer therein, the power shell is set with a storage battery therein; the first electrode and the second electrode of the first connector respectively connect with positive and negative electrodes of the atomizer; and the first electrode and the second electrode of the second connector respectively connect with positive and negative electrodes of the storage battery.

7. An electronic cigarette with magnetic connection, comprising an inhaling shell and a power shell, wherein, a connection end of the inhaling shell coupled to the power shell is set with a first connector, the first connector comprises a first seat and a first terminal post respectively used as a first and a second electrodes of the first connector, the first seat wholly or partly forms a first magnetic-attraction part; a connection end of the power shell coupled to the inhaling shell is set with a second connector, the second connector comprises a second seat and a second terminal post respectively used as a first and a second electrodes of the second connector, the second seat wholly or partly forms a second magnetic-attraction part which can magnetically attracts the first magnetic-attraction part; the first magnetic-attraction part and the second magnetic-attraction part attracts each other, which makes the first seat and the second seat contacted and makes the first terminal post and the second terminal post contacted;

the first connector further comprises a first insulation sleeve for spacing the first seat and the first terminal post, the first seat is shaped as a cylinder, the first terminal post is inserted in center of the first seat via the first insulation sleeve; the second connector further comprises a second insulation sleeve for spacing the second seat and the second terminal post, the second seat is shaped as a cylinder, and the second terminal post is inserted in center of the second seat via the second insulation sleeve;

wherein, the second seat defines an air passage therein for receiving the first seat, the second magnetic absorption part is a permanent magnet, the permanent magnet is fixed in the air passage of the second seat, and one end of the first seat is inserted in the second seat and keeps a preset distance from the permanent magnet.

8. The electronic cigarette with magnetic connection of claim 7, wherein, the air passage of the second seat is an axially-thorough hole, an inner wall of the air passage forms a positioning step, the second terminal post is inserted in the second seat and abuts against one end of the permanent magnet so that the other end of the permanent magnet abuts against the positioning step, therefore the permanent magnet is fixed in the air passage of the second seat.

9. The electronic cigarette with magnetic connection of claim 8, wherein, the second seat has a shape adapted to an inner wall of the connection end of the power shell, has a cylindrical structure, fixed with interference fit in the inner wall of the connection end of the power shell via its outer wall; a fixed flange adapted to the connection end of the power shell radially extends outwards from an end wall of the second seat, and the fixed flange radially defines a thorough air inlet.

10. The electronic cigarette with magnetic connection of claim 7, wherein, the first seat comprises a cylindrical upper section and a cylindrical lower section, the upper section is used for coupling the connection end of the inhaling shell, the lower section is used for coupling the second seat; a positioning flange is formed between the upper section and the lower section and axially extends outwards for engaging with the connection end of the inhaling shell, the positioning flange is used to abut against and limit the second seat; the lower section forms a snap ring on its inner wall for mounting the first terminal post, the first terminal post is fixed in the snap ring via the first insulation sleeve, and the first terminal post defines an air hole axially through its center.

11. The electronic cigarette with magnetic connection of claim 10, wherein, the lower section of the first seat defines an annular air groove near the positioning flange, and an air inlet is defined radially through the annular air groove.

* * * * *